US009410472B2

(12) United States Patent
Gacka et al.

(10) Patent No.: US 9,410,472 B2
(45) Date of Patent: Aug. 9, 2016

(54) INTERNAL COMBUSTION ENGINE WITH CARTRIDGE STYLE WATER PUMP ASSEMBLY

(71) Applicant: Honda Motor Co., Ltd., Tokyo (JP)

(72) Inventors: Thomas B. Gacka, Dublin, OH (US); Steven K. Walters, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 328 days.

(21) Appl. No.: 14/289,698

(22) Filed: May 29, 2014

(65) Prior Publication Data

US 2015/0345366 A1 Dec. 3, 2015

(51) Int. Cl.
*F01P 5/12* (2006.01)

(52) U.S. Cl.
CPC ..... *F01P 5/12* (2013.01); *Y10T 29/49233* (2015.01)

(58) Field of Classification Search
CPC ..... F01P 5/10; F01P 5/12; F01P 5/00; Y10T 29/49233
See application file for complete search history.

(56) References Cited

U.S. PATENT DOCUMENTS

| | | | | |
|---|---|---|---|---|
| 1,461,711 | A | 7/1923 | Bull | |
| 5,188,065 | A | 2/1993 | Lyndhurst et al. | |
| 5,279,265 | A * | 1/1994 | Matsuo | F01P 5/10 123/195 C |
| 7,086,369 | B2 | 8/2006 | Stone | |
| 7,194,994 | B1 | 3/2007 | Chisenhall et al. | |

* cited by examiner

*Primary Examiner* — Lindsay Low
*Assistant Examiner* — Jacob Amick
(74) *Attorney, Agent, or Firm* — Rankin, Hill & Clark LLP

(57) ABSTRACT

An internal combustion engine includes a cylinder block having a cylinder head connected to an upper end thereof. A front end of the cylinder block has a coolant introduction passage. A timing chain provided at the front end is engaged to a camshaft sprocket associated with the cylinder head. A timing chain cover is mounted to and spaced forward of the cylinder block front end. A water pump assembly includes a pump housing and an impeller assembly. The pump housing is directly secured to the cylinder block and interposed between the timing chain cover and the front end of the cylinder block. The pump housing has a pump chamber in fluid communication with the coolant introduction passage. The impeller assembly is removably mounted in the pump chamber without removal of the timing chain cover. An end of an impeller drive shaft extends forward of the timing chain cover.

20 Claims, 6 Drawing Sheets

INTERNAL COMBUSTION ENGINE WITH CARTRIDGE STYLE WATER PUMP ASSEMBLY

BACKGROUND

A known water pump for an internal combustion engine includes a pump housing secured to a front end of a cylinder block and an impeller rotatably supported on the pump housing. The water pump typically requires disassembly of certain engine components to which the water pump is attached in order to gain access to pump bearings, seals, impellers, etc., as for replacements. For example, it is known to position a water pump behind a timing chain with an impeller of the water pump being driven by the timing chain. The pump housing of the water pump for housing the impeller is located on the same component that supports a pump bearing and shaft. However, with this known arrangement, servicing and/or replacement of the water pump requires disassembly of the timing chain system and can be difficult and expensive.

BRIEF DESCRIPTION

In accordance with one aspect, an internal combustion engine for a vehicle comprises a cylinder block having a cylinder head connected to an upper end of the cylinder block. A front end of the cylinder block has a coolant introduction passage. A timing chain provided at the front end of the cylinder block is engaged to a camshaft sprocket operably associated with the cylinder head. A timing chain cover is mounted to the cylinder block and spaced forward of the front end of the cylinder block. A water pump assembly includes a pump housing and an impeller assembly. The pump housing is directly secured to the cylinder block and interposed between the timing chain cover and the front end of the cylinder block. The pump housing has a pump chamber in fluid communication with the coolant introduction passage. The impeller assembly is removably mounted in the pump chamber of the pump housing. The impeller assembly includes an impeller having a hub affixed to a drive shaft to be rotated about an axis defined by the drive shaft. An end of the drive shaft extends forward of the timing chain cover. The impeller assembly is adapted to be removed from the pump housing without removal of the timing chain cover.

In accordance with another aspect, a V-type internal combustion engine comprises a cylinder block having left and right banks and left and right spaced cylinder heads fixedly connected to respective upper ends of the left and right banks of the cylinder block. A front end of the cylinder block has a coolant introduction passage. At least one timing chain provided at the front end of the cylinder block is engaged to a camshaft sprocket operably associated with one of the left and right cylinder heads. A timing chain cover is mounted to the cylinder block and spaced forward of the front end of the cylinder block. The front end of the cylinder block and the timing chain cover together define a partially enclosed space for housing the at least one timing chain. A water pump assembly includes a pump housing and an impeller assembly. The pump housing is directly secured to both the cylinder block and at least one of the left and right cylinder heads. The pump housing is interposed between the timing chain cover and the front end of the cylinder block. A mounting structure of the pump housing is sealingly engaged to the cylinder block and the one cylinder head and is positioned behind the at least one timing chain. The pump housing has a pump chamber in fluid communication with the coolant introduction passage. The impeller assembly is removably mounted in the pump chamber of the pump housing. The impeller assembly includes an impeller having a hub affixed to a drive shaft to be rotated about an axis defined by the drive shaft. The drive shaft of the impeller assembly is driven by a front end accessory drive belt located forward of the timing chain cover.

In accordance with yet another aspect, a method of mounting a water pump assembly to a V-type internal combustion engine is provided. The method comprises positioning a mounting structure of a pump housing of the water pump assembly behind a timing chain located at a front end of a cylinder block of the internal combustion engine; positioning the pump housing on the front end of the cylinder block such that a pump chamber defined by the pump housing is in communication with a coolant introduction passage provided on the front end of the cylinder block; securing the mounting structure of the pump housing directly to both the cylinder block and to left and right cylinder heads of the internal combustion engine; releasably securing an impeller assembly of the water pump assembly in the pump chamber of the pump housing; aligning an opening located on a timing chain cover with the impeller assembly such that a drive shaft of the impeller assembly projects outwardly from the timing chain cover; mounting the timing chain cover to the front end of the cylinder block, the opening being dimensioned to allow the impeller assembly to be removed from the pump housing without removal of the timing chain cover from the cylinder block; and mounting a front end accessory drive belt to the drive shaft of the impeller assembly.

DETAILED DESCRIPTION

It should, of course, be understood that the description and drawings herein are merely illustrative and that various modifications and changes can be made in the structures disclosed without departing from the present disclosure. In general, the figures of the exemplary internal combustion engine with cartridge style water pump assembly are not to scale. It will also be appreciated that the various identified components of the exemplary internal combustion engine with cartridge style water pump assembly disclosed herein are merely terms of art that may vary from one manufacturer to another and should not be deemed to limit the present disclosure.

Figure 1:
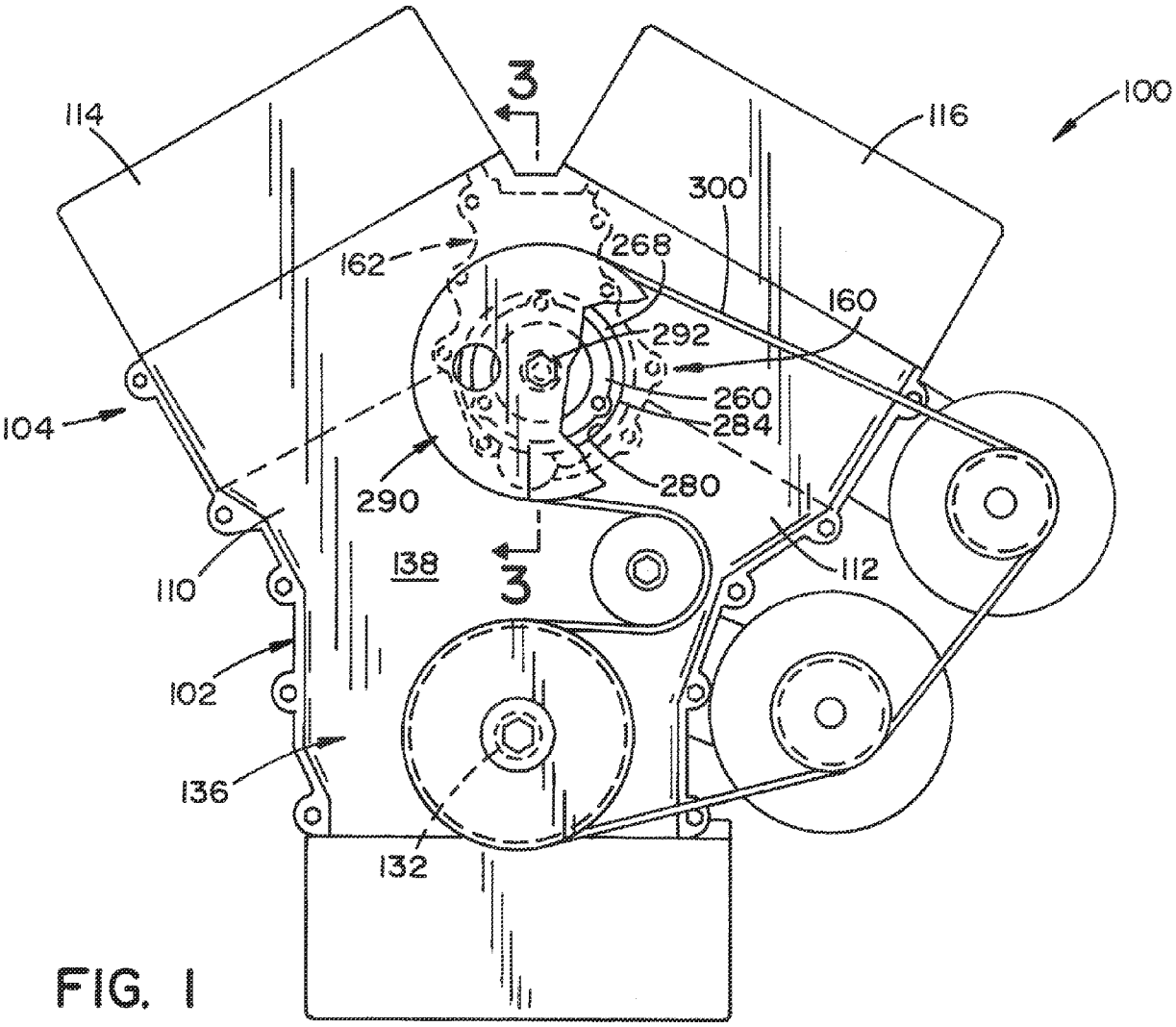
FIG. 1 is a front schematic view of an internal combustion engine with a cartridge style water pump assembly.
Figure 2:
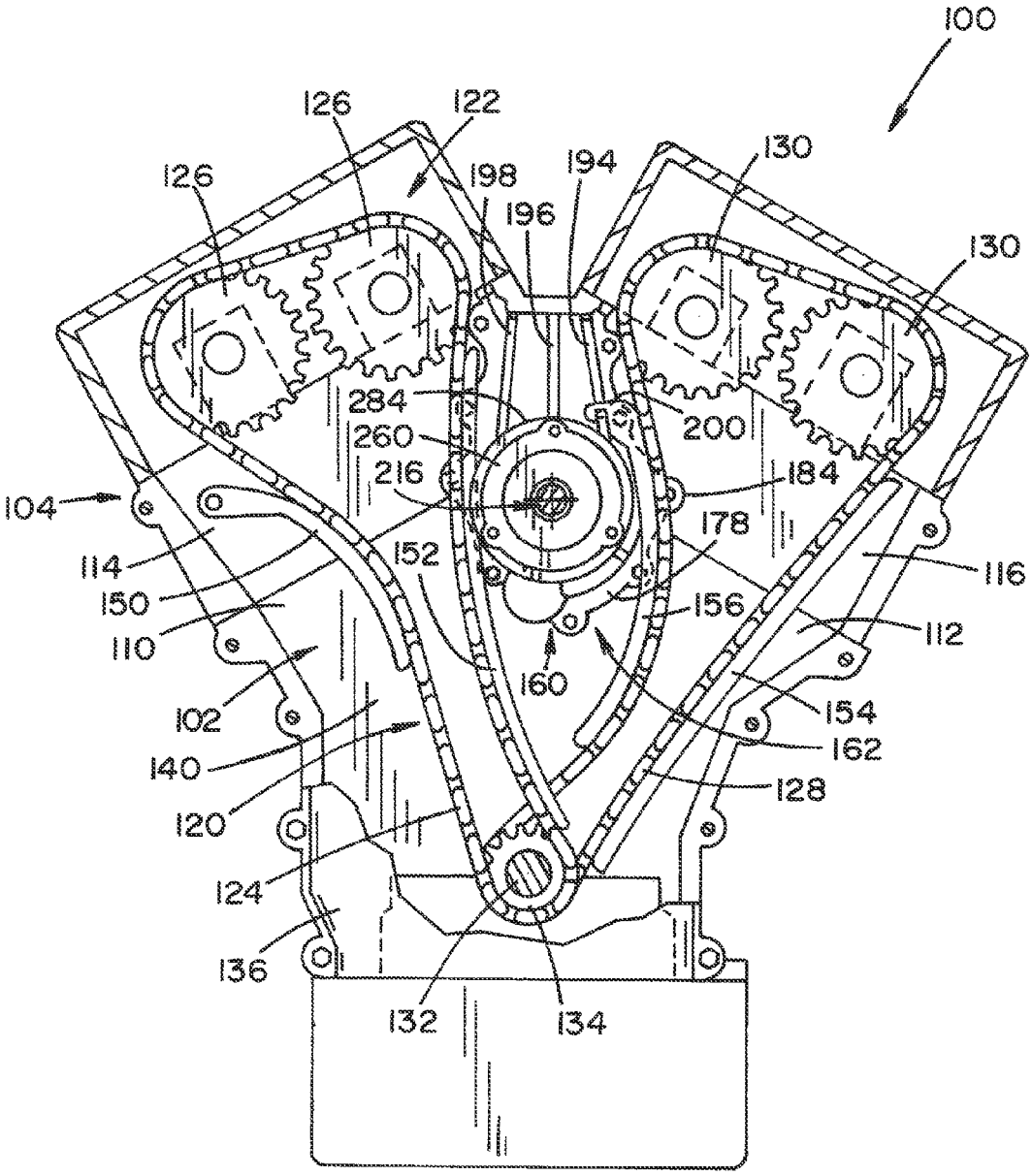
FIG. 2 is a front schematic view of FIG. 1 with a timing chain cover partially broken away to depict a timing chain and the water pump assembly.

Referring now to the drawings, wherein like numerals refer to like parts throughout the several views, FIGS. 1 and 2 schematically illustrate an internal combustion engine 100 for a vehicle (not shown). The internal combustion engine 100 includes a cylinder block 102 having a cylinder head 104 connected to an upper end of the cylinder block. In the depicted embodiment, the internal combustion engine 100 is a V-type internal combustion engine and the cylinder block 102 has left and right banks 110, 112 and the cylinder head 104 is defined by left and right cylinder heads 114, 116 fixedly connected to respective upper ends of the left and right banks 110, 112 of the cylinder block. At least one timing chain 120 is provided at a front end 140 of the cylinder block 102 and engaged to at least one camshaft sprocket 122 operably associated with the cylinder head 104. With the V-type internal combustion engine, the at least one timing chain 120 includes a first timing chain 124 engaged to camshaft sprockets 126 operably associated with the left cylinder head 114 and a second timing chain 128 engaged to camshaft sprockets 130 operably associated with the right cylinder head 116. As shown in FIG. 2, a crankshaft 132 is installed on a lower end of the cylinder block 102. A crankshaft sprocket 134 is installed on the crankshaft 132 for rotation therewith. The first timing chain 124 is placed around and engaged with the camshaft sprockets 126 and the crankshaft sprocket 134 and the second timing chain 128 is placed around and engaged with the camshaft sprockets 130 and the crankshaft sprocket 134.

Figure 3:
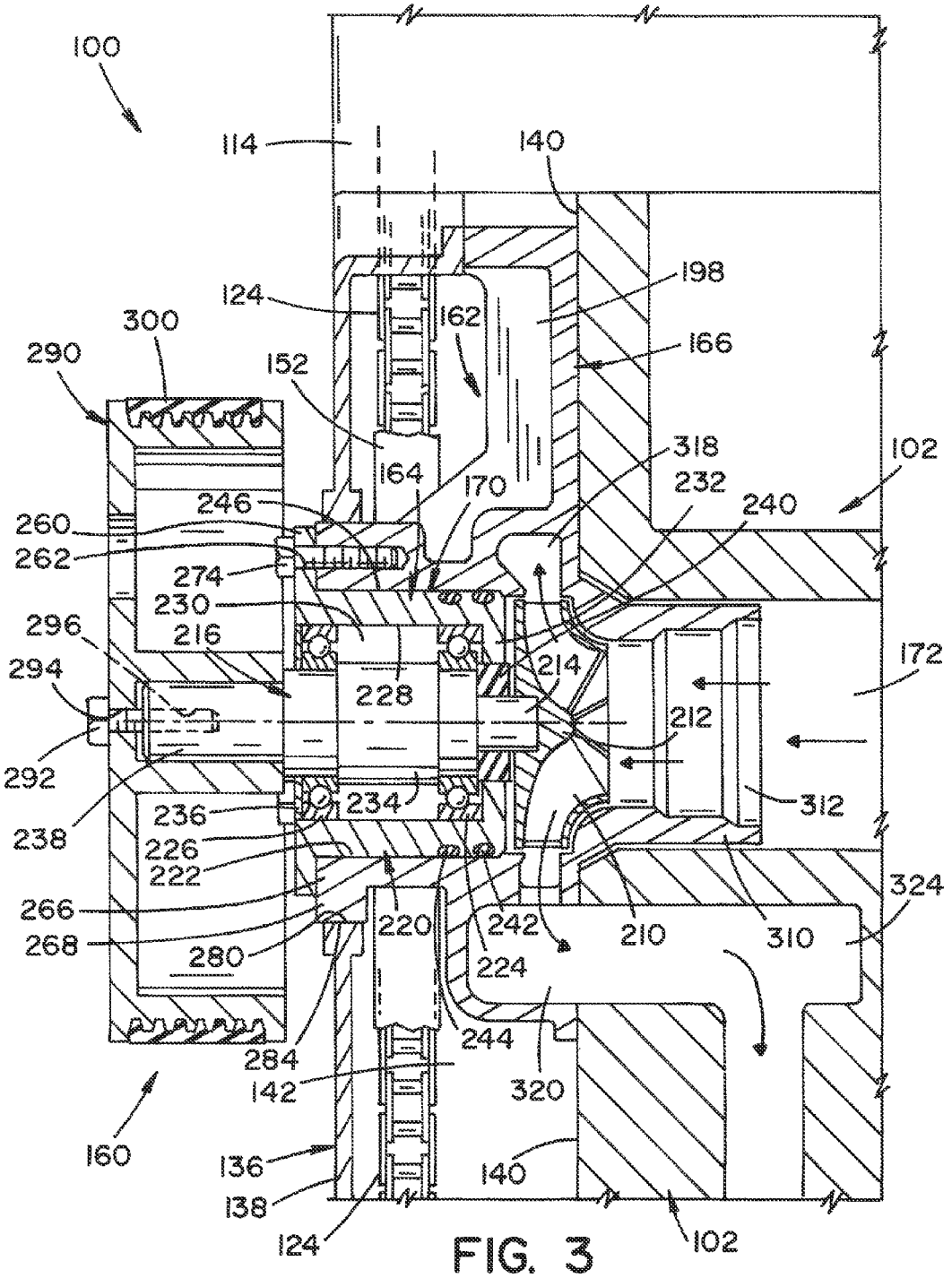
FIG. 3 is a cross-sectional view taken along line 3-3 of FIG. 1 according to one aspect of the present disclosure.

A timing chain cover 136 is mounted to the cylinder block 102 so as to cover the cylinder block and a lower part of each of the left and right cylinder heads 114, 116. The timing chain cover 136 can be fixedly attached to the cylinder block by any mechanical means known in the art, such as but not limited to bolts which threadingly engage mounting holes located on the cylinder block 102. A forward wall or surface 138 of the timing chain cover 136 is spaced forward of the front end 140 of the cylinder block 102. As best depicted in FIG. 3, the front end 140 of the cylinder block 102 and the forward wall 138 of the timing chain cover 136 together define a partially enclosed space or timing chain chamber 142 for housing the first and second timing chains 124, 128. As shown in FIG. 2, a pair of timing chain guides 150, 152 supported on the front end 140 of the cylinder block 102 provides tension to the first timing chain 124. Similarly, a pair of timing chain guides 154, 156 also supported on the front end 140 of the cylinder block 102 provides tension to the second timing chain 128.

Figure 4:
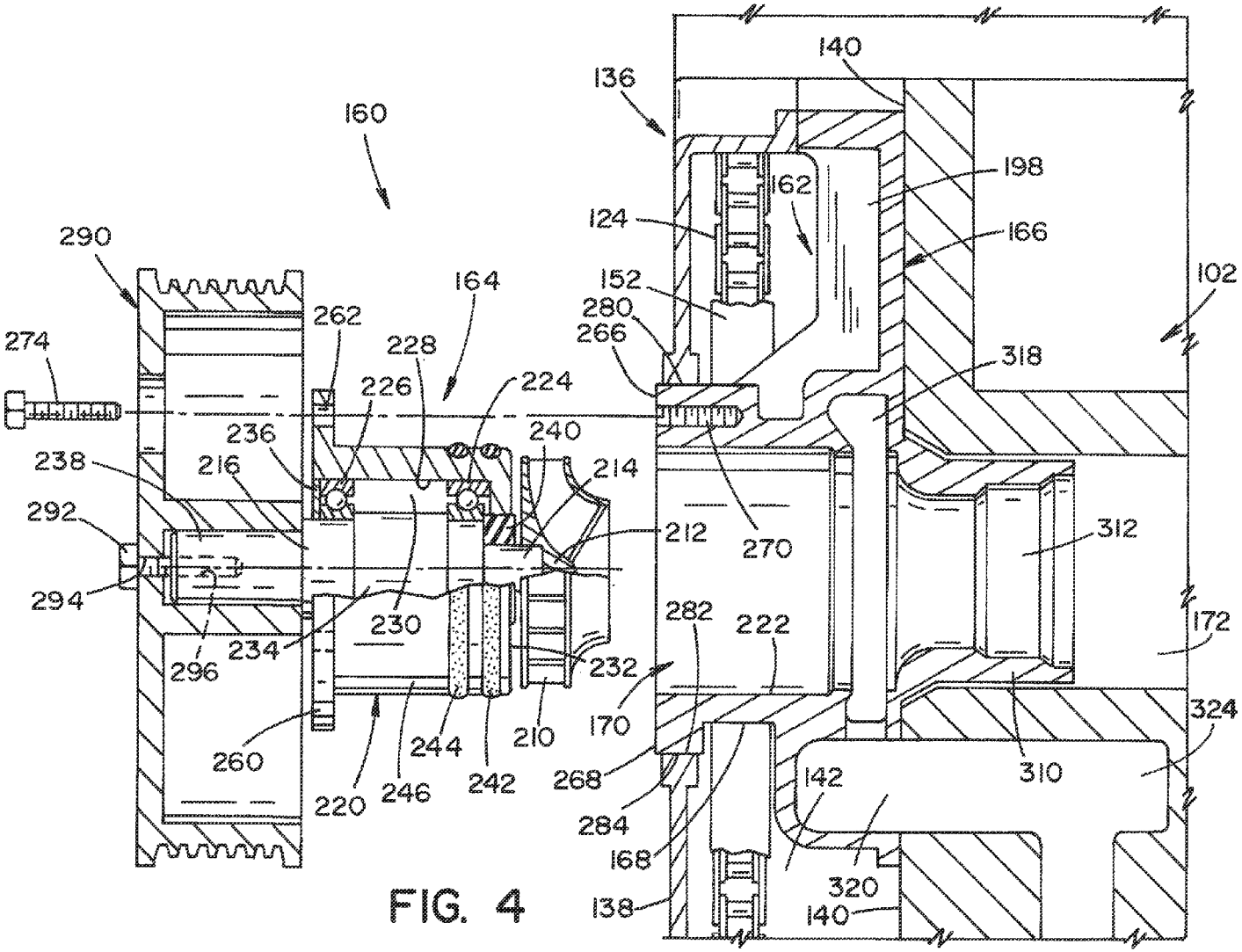
FIG. 4 is an exploded view of FIG. 3.
Figure 5:
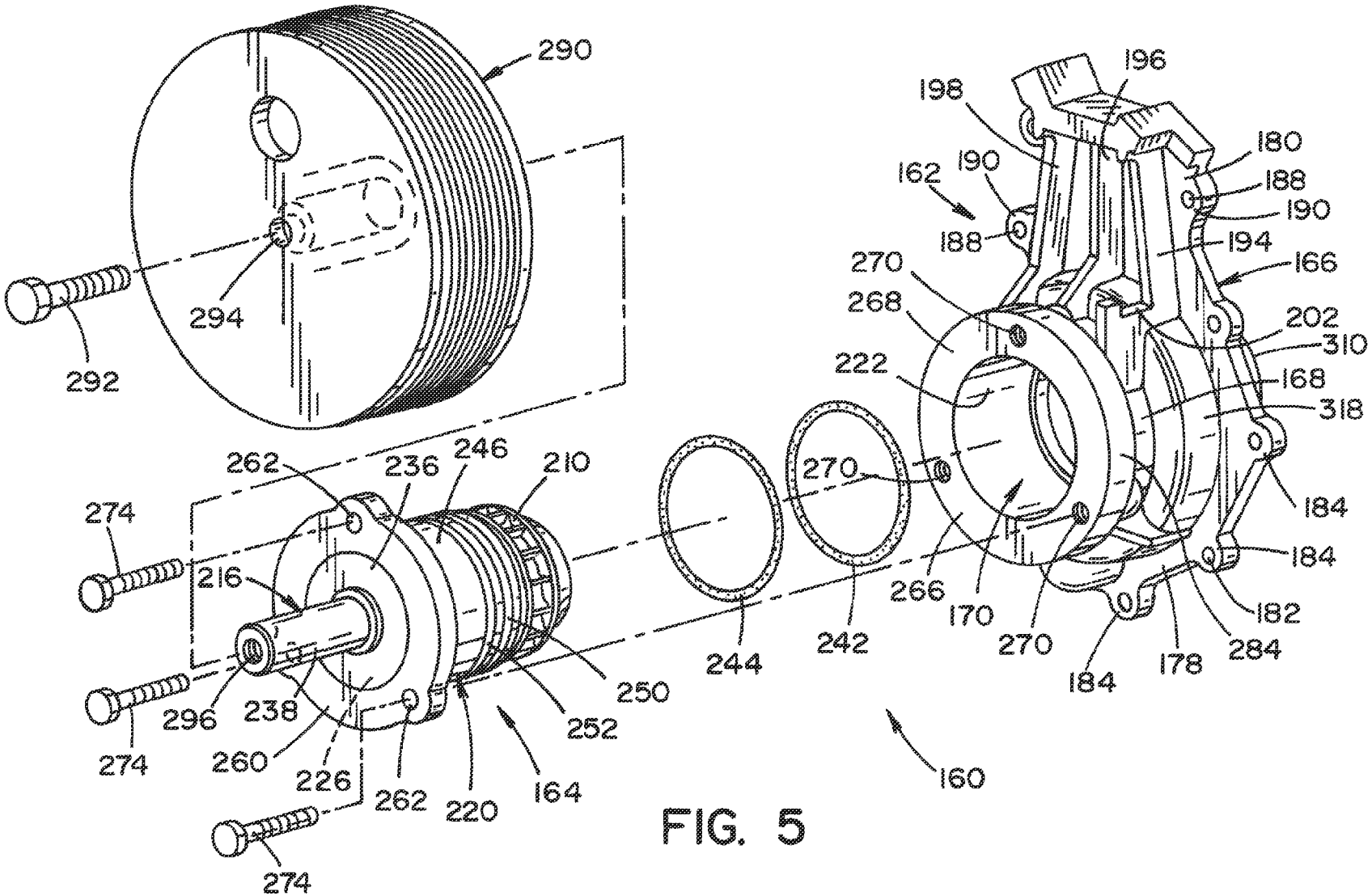
FIG. 5 is an exploded perspective view of the water pump assembly of FIG. 1.

The internal combustion engine 100 further includes an exemplary water pump assembly 160 according to the present disclosure. With reference to FIGS. 3-5, the water pump assembly 160 includes a pump housing 162 and an impeller assembly 164. The pump housing 162, which can be a one-piece pump housing, is directly secured to the both the cylinder block 102 and at least one of the left and right cylinder heads 114, 116. As depicted, a mounting structure 166 of the pump housing 162 is sealingly engaged to both the cylinder block 102 and each of the left and right cylinder heads 114, 116. The pump housing 162 is further interposed between the timing chain cover 136 and the front end 140 of the cylinder block 102 with the mounting structure 166 of the pump housing positioned behind each of the first and second timing chains 124, 128. The pump housing 162 includes a body 168 defining a pump chamber 170 in fluid communication with a coolant introduction passage 172 located at the front end 140 of the cylinder block 102. The body 168 extends from the front end 140 of the cylinder block 102 a distance approximately equal to the spacing between the front end 140 and the forward wall 138 of the timing chain cover 136, with the body 168 at least partially supporting the forward wall 138.

The mounting structure 166 extends from the body 168 and has a first portion 178 secured to the cylinder block 102 and a second portion 180 secured to the left and right cylinder heads 114, 116. In the depicted embodiment, the first portion 178 of the mounting structure 166 extends radially from and at least partially circumscribes the body 168. A plurality of spaced mounting openings 182 is provided on the first portion 178, and according to one aspect, the mounting openings 182 are located on spaced tabs 184 projecting from the first portion. The mounting openings 182 are sized to receive fasteners, such as bolts, which extend through the openings and threadingly engage corresponding mounting holes (not shown) on the front end 140 of the cylinder block 102. The second portion 180 of the mounting structure 166 extends perpendicularly from the body 168 and is sized to interconnect the left and right cylinder heads 114, 116. Similar to the first portion 178, a plurality of spaced mounting openings 188 is provided on the second portion 180, and the mounting openings 188 can be located on spaced tabs 190 projecting from the second portion. The mounting openings 188 are sized to receive fasteners, such as bolts, which extend through the openings and threadingly engage corresponding mounting holes (not shown) on the left and right cylinder heads 114, 116. With this configuration of the mounting structure 166, the pump housing 162 is supported on both the cylinder block 102 and the cylinder heads 114, 116.

Further, as shown in FIG. 5, at least one strengthening rib 194 extends from the body 168 and onto the second portion 180 of the mounting structure 166. In the depicted embodiment, the pump housing 162 is provided with three spaced strengthening ribs 194, 196, 198. With reference back to FIG. 2, an end portion 200 of the timing chain guide 156 is connected to the strengthening rib 194. To this end, the strengthening rib 194 can be provided with a cutout 202 dimensioned to receive the end portion 200 and the end portion 200 can include a recess (not shown) for engaging the strengthening rib 194. Therefore, the exemplary pump housing 162 can be used to support components of the timing chain system.

With reference again to FIGS. 3-5, the impeller assembly 164 is removably mounted in the pump chamber 170 of the pump housing 162. In the depicted embodiment, the impeller assembly 164 includes an impeller 210 having a hub 212 affixed to a first end portion 214 of a drive shaft 216 to be rotated about an axis defined by the drive shaft. The drive shaft 216 is housed in an impeller housing 220 dimensioned to be received in the pump chamber 170. In the illustrated embodiment, an inner surface 222 of the body 168 that defines the pump chamber 170 is cylindrical shaped with an axis coincident with the drive shaft axis, and the impeller housing 220 is similarly shaped. The impeller assembly 164 also may include a single bearing or a pair of bearings 224, 226 positioned between a periphery of the drive shaft 216 and an inner surface 228 of the impeller housing 220 which defines a bore 230. The bearings 224, 226 mount the drive shaft 216 in the bore 230 of the impeller housing 220 for rotation. As shown, bearing 224 is located between an end wall 232 of the impeller housing 220 and an enlarged section 234 of the drive shaft 216. A retaining ring 236 can be positioned on a second end portion 238 of the drive shaft 216 to retain the bearing 226 against the enlarged section 234 in the impeller housing 220. In addition, to prevent intrusion of coolant into the bearings 224, 226, an annular seal 240 is provided about a section of the first end portion 214 of the drive shaft 216 that extends through the end wall 232, between the impeller 210 and bearing 224. Additional seals 242, 244 are located between an outer surface 246 of the impeller housing 220 and the inner surface 222 of the body 168. The seals 242, 244 are provided in respective annular grooves 250, 252 in the outer surface 246. A weep hole (not shown) provided in the impeller housing 220 extends to a clearance at the annular seal 240 to drain leakage to the exterior of the pump housing 162.

A mounting flange 260 having spaced mounting openings 262 is formed with the impeller housing 220 opposite the end wall 232. The mounting flange 260 has a shape corresponding to a forward annular mounting flange 266 provided on the body 168 of the pump housing 162. A mounting face 268 of the flange 266 includes spaced threaded apertures 270. The mounting flange 260 of the impeller assembly 164 is fastened to the face 268 of the mounting flange 266 of the pump housing 162, for example, by the depicted bolts 274. Further, the timing chain cover 136 includes an opening 280 which when the timing chain cover 136 is mounted to the cylinder block 102 is axially aligned with the pump chamber 170. The opening 280 is dimensioned to receive the mounting flanges 260, 266, and as shown, a surface 282 of the timing chain cover 136 that defines the opening 280 abuts an outer surface 284 of the mounting flange 266. In the assembled condition shown in FIG. 3, the mounting flange 260 is outwardly spaced from the forward wall 138 of the timing chain cover 136. The second end portion 238 of the drive shaft 216 has a water pump sprocket 290 installed thereon, by, for example, a bolt 292 extending through an opening 294 in the sprocket 290 and threaded in an aperture 296 in the second end portion 238. The sprocket 290 is driven by a front end accessory drive belt 300 (FIG. 1). The water pump sprocket 290 is located outside and forward of the timing chain cover 136. The sprocket 290 and belt 300 may be of toothed construction, as is typical in timing belts. Because the impeller assembly 164 includes the moving parts which may need replacement, such replacement is quickly and easily facilitated as by easy separation of the impeller assembly 164 from the pump housing 162, and the opening 280 allows the impeller assembly 164 to be removed from the pump housing 162 without removal of the timing chain cover 136 from the cylinder block 102. Ease of disconnection of the impeller assembly 164 from the pump housing 162 is clear from FIG. 5.

With reference again to FIGS. 3 and 4, the pump housing 162 includes a cylindrical shaped flange or conduit 310 extending from the mounting structure 166 opposite the body 168. The conduit 310 is dimensioned to be received in the coolant introduction passage 172 provided in the front end 140 of the cylinder block 102 and defines a fluid passage 312 in communication with the pump chamber 170. The pump housing 162 further defines a volute 318 located downstream of the fluid passage 312 of the conduit 310 and upstream of the pump chamber 170. A discharge port 320 provided on the mounting structure 166 spaced from the conduit 310 is in communication with the volute 318. In the assembled condition (FIG. 3), the impeller 210 is located in the volute 318, and coolant received in the pump chamber 170 from the fluid passage 312 flows in an outward direction to the volute 318 as the impeller 210 rotates. The coolant is then directed from the volute 318 to the discharge port 320. Coolant pressurized by the water pump assembly 160 is forced to flow from the front end 140 of the cylinder block 102 into the water jackets 324 of the cylinder block 102 and the water jackets (not shown) of the left and right cylinder heads 114, 116 and then rearward of the internal combustion engine 100. As is well known, thereafter, coolant is discharged from a coolant outlet at a rear end of the engine 100 and conducted through a coolant passage to a radiator (not shown). From the radiator, coolant is conducted back into the coolant introduction passage 172 and water pump assembly 160.

Figure 6:
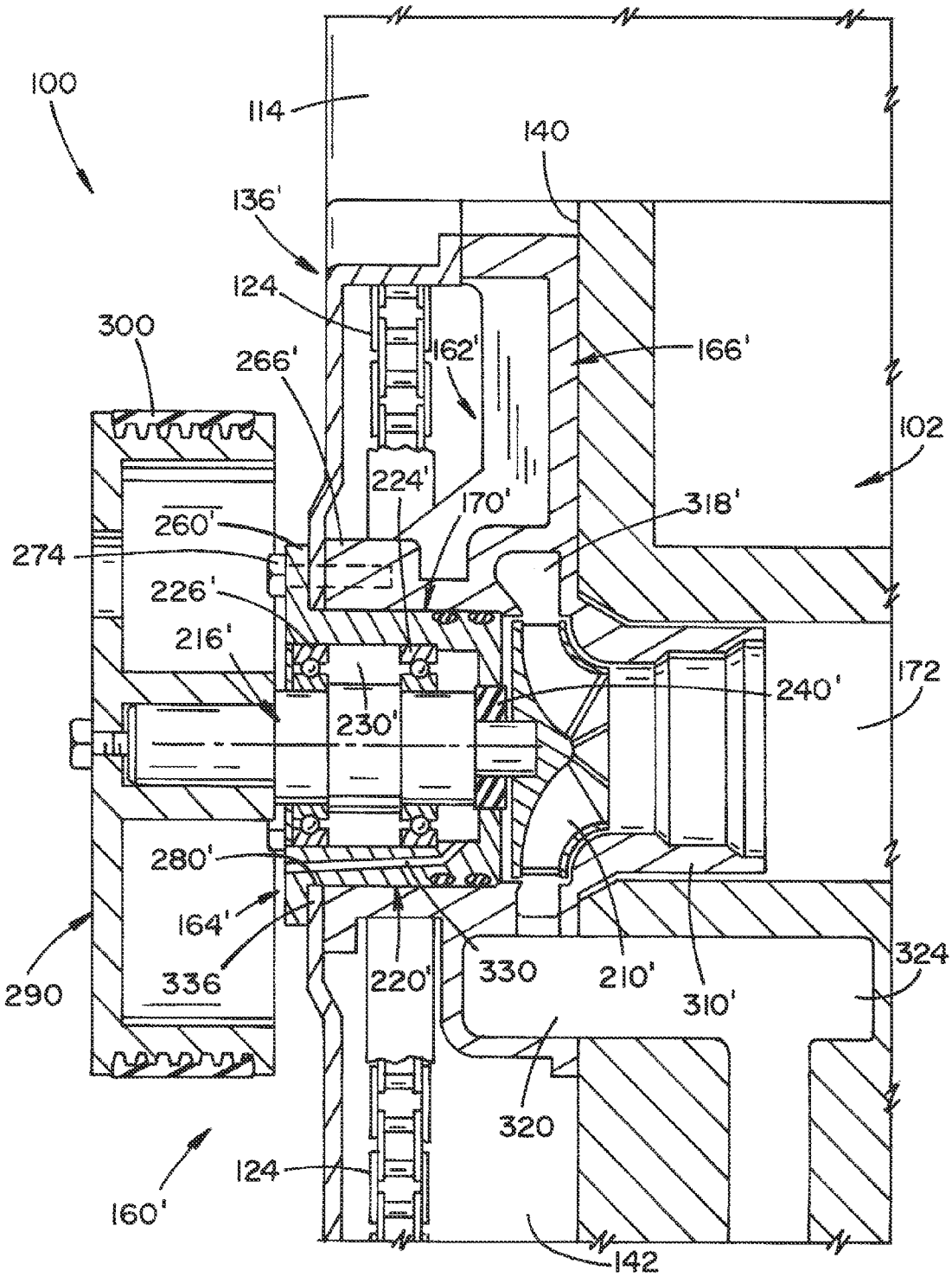
FIG. 6 is a cross-sectional view taken along line 3-3 of FIG. 1 according to another aspect of the present disclosure

FIG. 6 depicts a water pump assembly 160' according to another aspect of the present disclosure. Except as indicated herein, the water pump assembly is the same as the water pump assembly 160 of FIGS. 3-5 and thus like reference numerals are used on like components (similar components are also identified with like reference numerals, but with a primed (') suffix, and new components are identified with new numerals). As shown in FIG. 6, the water pump assembly 160' includes the pump housing 162' and the impeller assembly 164'. The pump housing 162' includes the mounting structure 166' sealingly engaged to both the cylinder block 102 and at least one of the left and right cylinder heads 114, 116. The pump housing 162' is further interposed between the timing chain cover 136' and the front end 140 of the cylinder block 102 with the mounting structure 166' of the pump housing 162' positioned behind each of the first and second timing chains 124, 128 (only the first timing chain 124 is visible in FIG. 6).

The impeller assembly 164' is removably mounted in the pump chamber 170' of the pump housing 162'. The impeller assembly 164 includes the impeller 210' affixed to the drive shaft 216' housed in the impeller housing 220'. The pair of bearings 224', 226' positioned on the drive shaft 216' mounts the drive shaft in the bore 230' of the impeller housing 220'. Again to prevent intrusion of coolant into the bearings 224', 226', the annular seal 240' is provided about the drive shaft 216'. A drain passage 330 provided in the impeller housing 220' is in communication with the bore 230' to drain leakage to the exterior of the pump housing 162'. The mounting flange 260' of the impeller assembly 164' is fastened to the mounting flange 266' of the pump housing 162', for example, by the depicted bolts 274. According to the aspect depicted in FIG. 6, the timing chain cover 136' includes the opening 280' dimensioned to receive the impeller housing 220'. In the assembled condition, a portion 336 of the timing chain cover 136' is sandwiched between mounting flange 260' of the impeller assembly 164' and the mounting flange 266' of the pump housing 162'. This arrangement also allows for easy separation of the impeller assembly 164' from the pump housing 162' without removal of the timing chain cover 136' from the cylinder block 102.

As is evident from the foregoing, the present invention provides a method of mounting the water pump assembly 160 to the V-type internal combustion engine 100. The method comprises positioning the mounting structure 166 of the pump housing 162 behind the timing chain 120 located at the front end 140 of the cylinder block 102 of the internal combustion engine 100; positioning the pump housing 162 on the front end 140 such that the pump chamber 170 defined by the pump housing 162 is in communication with the coolant introduction passage 172 provided on the front end 140 of the cylinder block 102; securing the mounting structure 166 of the pump housing 162 directly to both the cylinder block 102 and to the left and right cylinder heads 114, 116; releasably securing the impeller assembly 164 in the pump chamber 170; aligning the opening 280 located on the timing chain cover 136 with the impeller assembly 164 such that the drive shaft 216 of the impeller assembly projects outwardly from the timing chain cover 136; mounting the timing chain cover 136 to the front end 140 of the cylinder block 102, the opening allowing the impeller assembly to be removed from the pump housing without removal of the timing chain cover from the cylinder block; and mounting the front end accessory drive belt 300 to the drive shaft 216. The method further includes sandwiching a portion of the timing chain cover between the pump housing and the impeller assembly. The method further includes supporting the timing chain guide 156 on the front end 140 of the cylinder block for providing tension to the timing chain 120 and connecting the end portion 200 of the timing chain guide 156 directly to the pump housing 162.

The present invention relates to the cartridge style water pump assembly 160 configured to be driven by the drive belt 300 of a front engine accessory drive. The pump housing 162 for housing the impeller assembly 164 is housed in the enclosed space 142 defined by the timing chain cover 136 and the mounting structure 166 is positioned behind the timing chain 120 so that it remains part of the cylinder block 102. This allows for removal of the impeller assembly 164 from the pump housing 162 for servicing and/or replacement without removal of the timing chain cover 136 and disassembly of the timing chain system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An internal combustion engine for a vehicle comprising:

a cylinder block having a cylinder head connected to an upper end of the cylinder block, a front end of the cylinder block having a coolant introduction passage;

a timing chain provided at the front end of the cylinder block and engaged to a camshaft sprocket operably associated with the cylinder head;

a timing chain cover mounted to the cylinder block and spaced forward of the front end of the cylinder block; and a water pump assembly including a pump housing and an impeller assembly, the pump housing being directly secured to the cylinder block and interposed between the timing chain cover and the front end of the cylinder block, the pump housing having a pump chamber in fluid communication with the coolant introduction passage, the impeller assembly being removably mounted in the pump chamber of the pump housing, the impeller assembly including an impeller having a hub affixed to a drive shaft to be rotated about an axis defined by the drive shaft, an end of the drive shaft extending forward of the timing chain cover, the impeller assembly being adapted to be removed from the pump housing without removal of the timing chain cover.

2. The internal combustion engine of claim 1, wherein the pump housing is a one-piece housing secured to the both the cylinder block and the cylinder head.

3. The internal combustion engine of claim 2, wherein the internal combustion engine is a V-type internal combustion engine, the cylinder block having left and right banks and left and right cylinder heads fixedly connected to respective upper ends of the left and right banks of the cylinder block, the pump housing being secured to both left and right cylinder heads.

4. The internal combustion engine of claim 2, wherein the pump housing includes a body defining the pump chamber, and a mounting structure extending from the body, the mounting structure having a first portion secured to the cylinder block and a second portion secured to the cylinder head.

5. The internal combustion engine of claim 4, further including a cylindrical shaped flange extending from the mounting structure, the flange defining a fluid passage in communication with the pump chamber, the flange dimensioned for insertion in the coolant introduction passage.

6. The internal combustion engine of claim 5, wherein the pump housing defines a volute located downstream of the fluid passage of the flange and upstream of the pump chamber and a discharge port in communication with the volute and provided on the mounting structure spaced from the flange, coolant received in the pump chamber flowing to the volute as the impeller rotates.

7. The internal combustion engine of claim 4, wherein the first portion of the mounting structure extends radially from and at least partially circumscribes the body, and the second portion of the mounting structure extends perpendicularly from the body.

8. The internal combustion engine of claim 4, wherein the front end of the cylinder block and the timing chain cover together define a partially enclosed space for housing the timing chain, the body of the pump housing extending from the front end of the cylinder block a distance approximately equal to the spacing between the front end and the timing chain cover.

9. The internal combustion engine of claim 1, wherein the impeller assembly includes a mounting flange fastened to a forward mounting face of the pump housing, the mounting flange being outwardly spaced from a forward wall of the timing chain cover, and the timing chain cover includes an opening dimensioned to receive the impeller assembly, the opening allowing the impeller assembly to be removed from the pump housing without removal of the timing chain cover from the cylinder block.

10. The internal combustion engine of claim 9, wherein a portion of the timing chain cover is sandwiched between the pump housing and the impeller assembly.

11. The internal combustion engine of claim 1, further including a timing chain guide supported on the front end of the cylinder block for providing tension to the timing chain, an end portion of the timing chain guide directly connected to the pump housing, and the pump housing includes a strengthening rib, the end portion of the timing chain guide connected to the strengthening rib.

12. The internal combustion engine of claim 1, wherein the drive shaft of the impeller assembly is driven by a front end accessory drive belt.

13. A V-type internal combustion engine comprising:

a cylinder block having left and right banks and left and right spaced cylinder heads fixedly connected to respective upper ends of the left and right banks of the cylinder block, a front end of the cylinder block having a coolant introduction passage;

at least one timing chain provided at the front end of the cylinder block and engaged to a camshaft sprocket operably associated with one of the left and right cylinder heads;

a timing chain cover mounted to the cylinder block and spaced forward of the front end of the cylinder block, the front end of the cylinder block and the timing chain cover together define a partially enclosed space for housing the at least one timing chain; and a water pump assembly including a pump housing and an impeller assembly, the pump housing being directly secured to both the cylinder block and at least one of the left and right cylinder heads and interposed between the timing chain cover and the front end of the cylinder block, a mounting structure of the pump housing sealingly engaged to the cylinder block and the one cylinder head and positioned behind the at least one timing chain, the pump housing having a pump chamber in fluid communication with the coolant introduction passage, the impeller assembly being removably mounted in the pump chamber of the pump housing, the impeller assembly including an impeller having a hub affixed to a drive shaft to be rotated about an axis defined by the drive shaft, the drive shaft of the impeller assembly being driven by a front end accessory drive belt located forward of the timing chain cover.

14. The V-type internal combustion engine of claim 13, wherein the pump housing is a one-piece housing and the mounting structure is secured to the both the cylinder block and each of the left and right cylinder heads, and the pump housing is not secured to the timing chain cover.

15. The V-type internal combustion engine of claim 14, wherein the mounting structure directly interconnects the left and right cylinder heads.

16. The V-type internal combustion engine of claim 13, wherein the pump housing extends from the front end of the cylinder block a distance approximately equal to the spacing between the front end of the cylinder block and the timing chain cover, the impeller assembly including a mounting flange fastened to a forward mounting face of the pump housing, the timing chain cover including an opening dimensioned to receive impeller assembly, the opening allowing the impeller assembly to be removed from the pump housing without removal of the timing chain cover from the cylinder block.

17. The V-type internal combustion engine of claim 13, wherein the pump housing includes a cylindrical shaped flange extending from the mounting structure and defining a fluid passage in communication with the pump chamber, the flange dimensioned to be received in the coolant introduction passage, the pump housing further defines a volute located downstream of the fluid passage of the flange and upstream of the pump chamber and a discharge port in communication with the volute and provided on the mounting structure spaced from the flange, coolant received in the pump chamber from the fluid passage flowing to the volute as the impeller rotates.

18. A method of mounting a water pump assembly to a V-type internal combustion engine comprising:

positioning a mounting structure of a pump housing of the water pump assembly behind a timing chain located at a front end of a cylinder block of the internal combustion engine;

positioning the pump housing on the front end of the cylinder block such that a pump chamber defined by the pump housing is in communication with a coolant introduction passage provided on the front end of the cylinder block;

securing the mounting structure of the pump housing directly to both the cylinder block and to left and right cylinder heads of the internal combustion engine;

releasably securing an impeller assembly of the water pump assembly in the pump chamber of the pump housing;

aligning an opening located on a timing chain cover with the impeller assembly such that a drive shaft of the impeller assembly projects outwardly from the timing chain cover;

mounting the timing chain cover to the front end of the cylinder block, the opening being dimensioned to allow the impeller assembly to be removed from the pump housing without removal of the timing chain cover from the cylinder block; and mounting a front end accessory drive belt to the drive shaft of the impeller assembly.

19. The method of claim 18, further including sandwiching a portion of the timing chain cover between the pump housing and the impeller assembly.

20. The method of claim 18, further including supporting a timing chain guide on the front end of the cylinder block for providing tension to the timing chain and connecting an end portion of the timing chain guide directly to the pump housing.

* * * * *